US009209568B2

(12) United States Patent
Yu et al.

(10) Patent No.: US 9,209,568 B2
(45) Date of Patent: Dec. 8, 2015

(54) CONNECTOR ASSEMBLY WITH ANTI-MISMATING MEMBERS

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Jhonghe (TW); Yung-Chih Hung, Jhonghe (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 0 days.

(21) Appl. No.: 14/246,510

(22) Filed: Apr. 7, 2014

(65) Prior Publication Data

US 2015/0180175 A1 Jun. 25, 2015

(30) Foreign Application Priority Data

Dec. 23, 2013 (CN) ..... 2013 1 0715247

(51) Int. Cl.

| | |
|---|---|
| ***H01R 13/64*** | (2006.01) |
| *H01R 13/627* | (2006.01) |
| *H01R 12/70* | (2011.01) |
| *H01R 13/41* | (2006.01) |

(52) U.S. Cl.

CPC ..... *H01R 13/64* (2013.01); *H01R 12/7088* (2013.01); *H01R 13/41* (2013.01); *H01R 13/6271* (2013.01)

(58) Field of Classification Search

CPC ... H01R 13/64; H01R 13/6456; H01R 13/645

See application file for complete search history.

(56) References Cited

U.S. PATENT DOCUMENTS

| | | | | |
|---|---|---|---|---|
| 6,168,475 | B1 * | 1/2001 | Ko | 439/680 |
| 6,364,718 | B1 * | 4/2002 | Polgar et al. | 439/680 |
| 7,214,086 | B1 * | 5/2007 | Hsieh | 439/352 |
| 7,462,067 | B1 * | 12/2008 | Whiteman et al. | 439/562 |
| 8,961,240 | B2 * | 2/2015 | Tai et al. | 439/680 |
| 2002/0072275 | A1 * | 6/2002 | Arai | 439/680 |
| 2011/0294361 | A1 * | 12/2011 | Schrader | 439/680 |

* cited by examiner

*Primary Examiner* — Gary Paumen

(74) *Attorney, Agent, or Firm* — Sughrue Mion, PLLC

(57) ABSTRACT

A connector assembly includes a receptacle connector and a plug connector. The receptacle connector includes a receptacle insulative housing including a receiving portion, a number of mating portions extending from the receiving portion and a number of contact-receiving slots extending through the mating portions and the receiving portion. At least one of the mating portions includes an anti-mismating block at a corner thereof. The plug connector includes a plug insulative housing including a mating surface and a number of cavities extending through the mating surface for receiving the mating portions. The plug insulative housing includes an anti-mismating groove at a corner of one of the cavities to receive the anti-mismating block of the receptacle insulative housing.

20 Claims, 8 Drawing Sheets

CONNECTOR ASSEMBLY WITH ANTI-MISMATING MEMBERS

BACKGROUND

1. Technical Field

The present invention relates to a connector assembly, and more particularly to a receptacle connector and a plug connector with anti-mismating members for preventing incorrectly mating.

2. Description of Related Art

With rapid development of electronic technologies, connector assemblies have been widely used in electronic devices for exchanging information and data with external devices. A conventional connector usually includes an insulative housing, a plurality of contacts received in the insulative housing and a metallic shell enclosing the insulative housing. The connector assembly includes a receptacle connector for being mounted to a circuit board and a plug connector for mating with the receptacle connector.

In order to meet the requirements of stable signal transmission and high effective transmission of the electronic devices, strong mating stabilization of the electrical connector needs to be ensured. However, the contacts of the conventional receptacle connector are usually directly inserted into the insulative housing without locking structures, as a result that the contacts easily withdraw from the insulative housing. Besides, since there is no reasonable mismatching protection structure, the plug connector can be incorrectly inserted into unmatchable receptacle connectors.

Hence, a connector assembly with improved anti-mismating structures is desired.

SUMMARY

An embodiment of the present invention provides a connector assembly including a receptacle connector and a plug connector mating with the receptacle connector. The receptacle connector includes a receptacle insulative housing and a plurality of female contacts. The receptacle insulative housing includes a receiving portion, a plurality of mating portions extending from the receiving portion and a plurality of contact-receiving slots extending through the mating portions and the receiving portion. At least one of the mating portions includes an anti-mismating block at a corner thereof. The female contacts are received in the contact-receiving slots. The plug connector includes a plug insulative housing and a plurality of male contacts fixed in the plug insulative housing. The plug insulative housing includes a mating surface and a plurality of cavities extending through the mating surface for receiving the mating portions. The plurality of male contacts extend into the cavities for mating with the female contacts. The plug insulative housing defines an anti-mismating groove at a corner of one of the cavities to receive the anti-mismating block of the receptacle insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENTS

Figure 1:
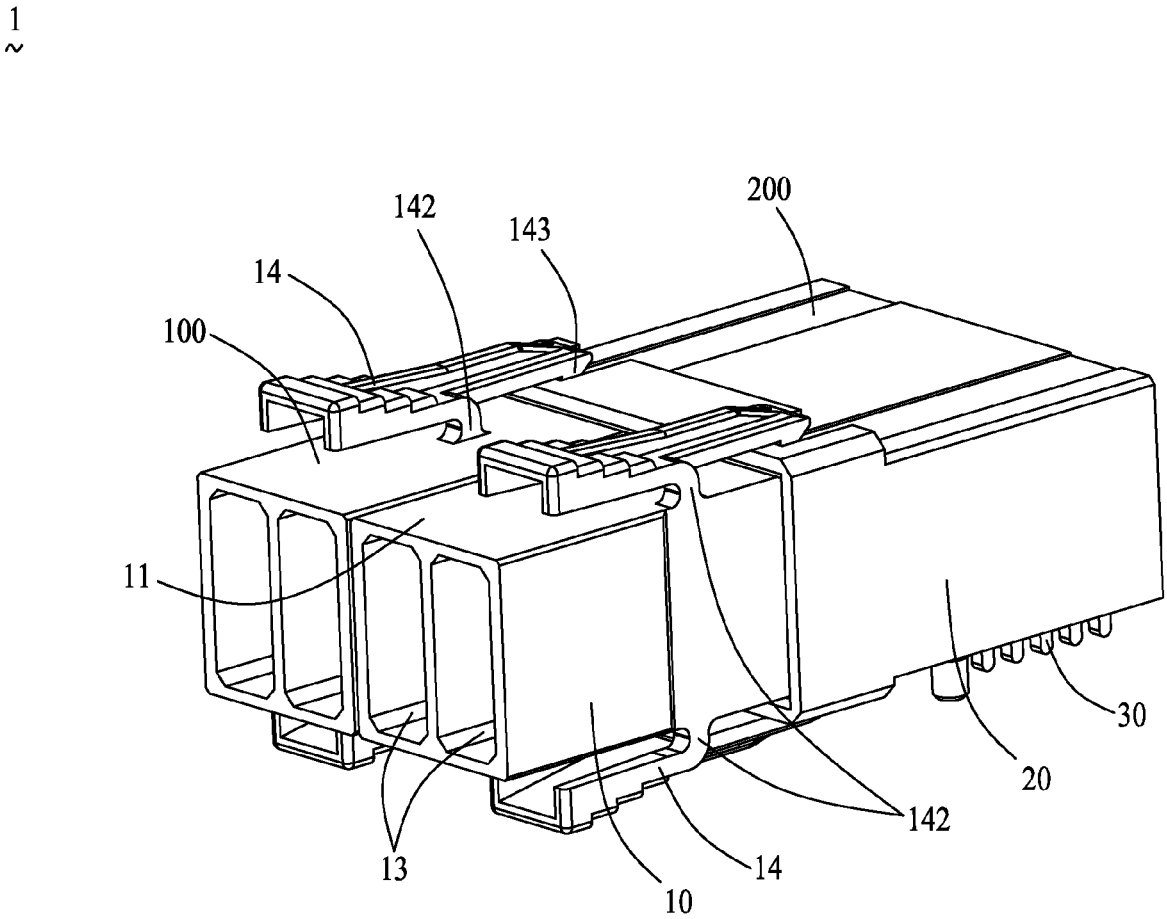
FIG. 1 is a perspective view of a connector assembly in accordance with an illustrated embodiment of the present invention.

Reference will now be made to the drawing figures to describe the embodiments of the present invention in detail. In the following description, the same drawing reference numerals are used for the same elements in different drawings.

Referring to FIG. 1, an illustrated embodiment of the present invention discloses a connector assembly 1 including a receptacle connector 100 and a plug connector 200 for being mounted to a circuit board (not shown) for mating with the receptacle connector 100.

Figure 2:
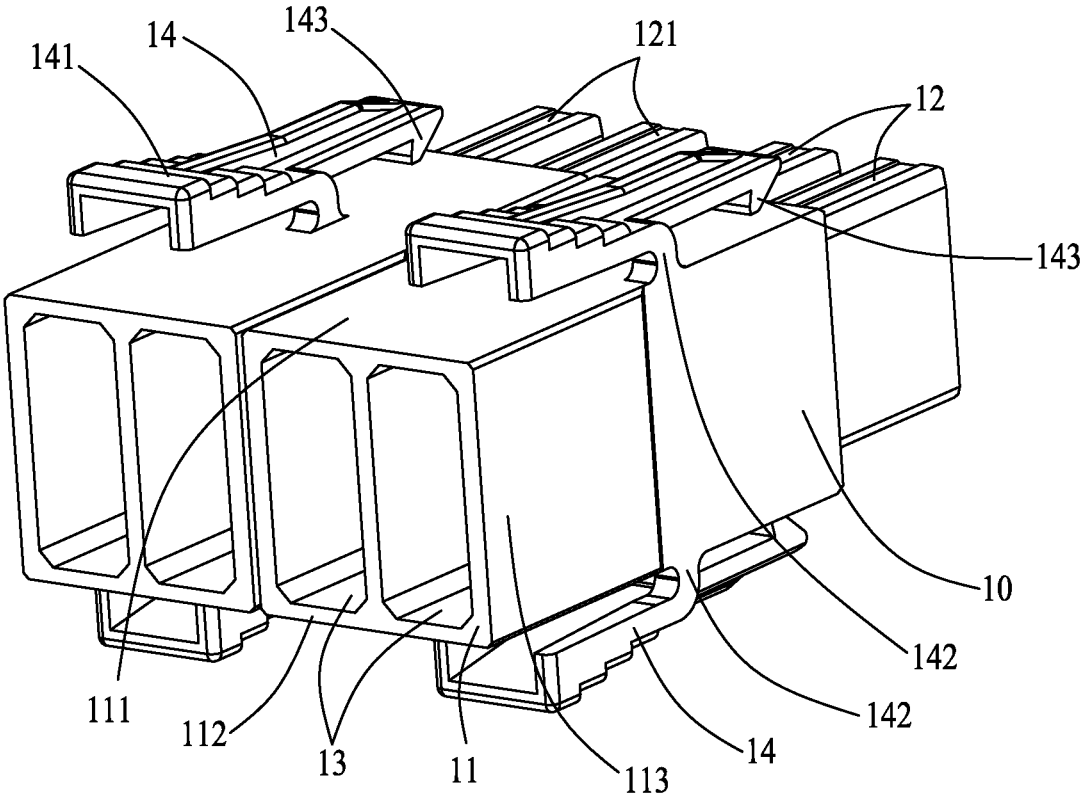
FIG. 2 is a perspective view of a receptacle connector as shown in FIG. 1.
Figure 3:
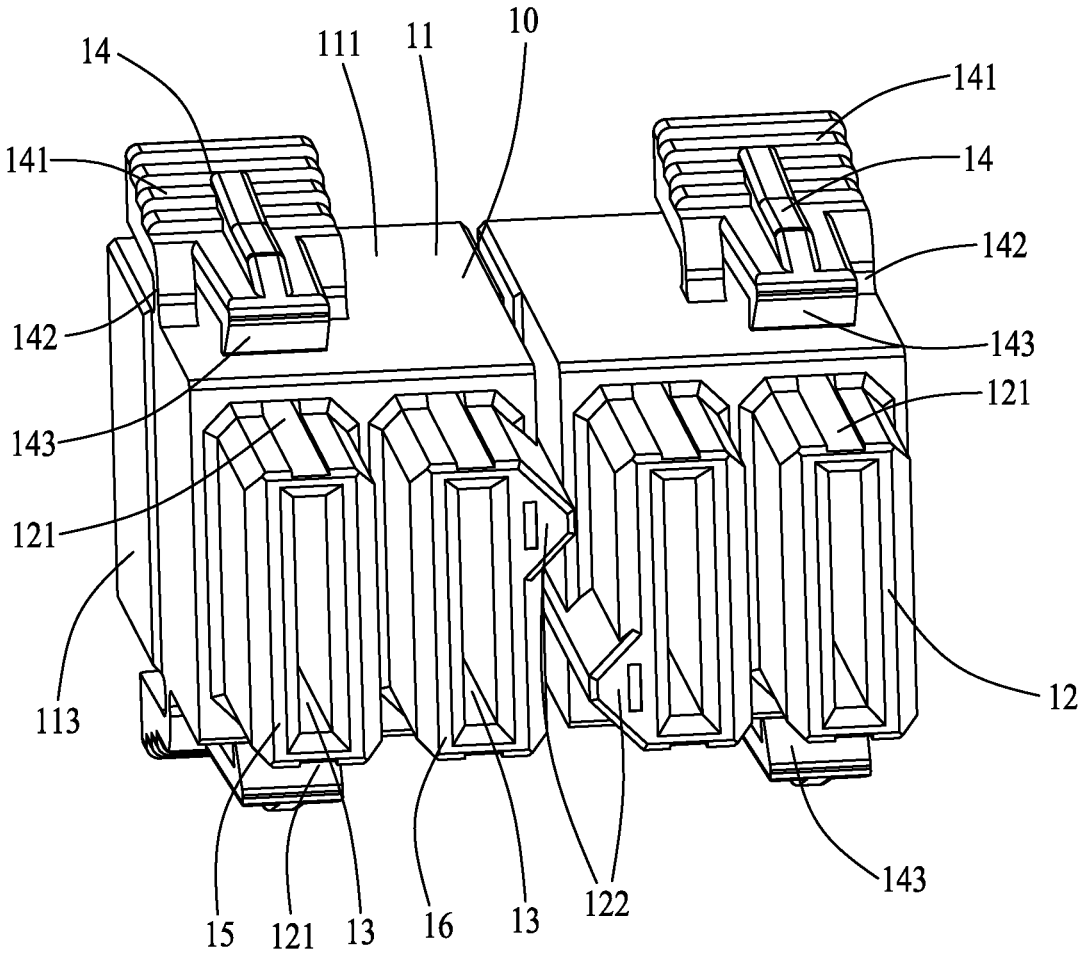
FIG. 3 is another perspective view of the receptacle connector as shown in FIG. 2.

Referring to FIGS. 2 and 3, the receptacle connector 100 includes a receptacle insulative housing 10 and a plurality of female contacts (not shown) retained in the receptacle insulative housing 10. The receptacle insulative housing 10 includes a receiving portion 11, a plurality of mating portions 12 extending from the receiving portion 11 and a plurality of contact-receiving slots 13 extending through the mating portions 12 and the receiving portion 11 along a first direction (i.e., a front-to-back direction).

According to the illustrated embodiment of the present invention, there are two mating portions 12 arranged side by side along a second direction (i.e., a width direction of the receptacle insulative housing 10) perpendicular to the first direction. The two mating portions 12 include a first mating portion 15 and a second mating portion 16 in parallel relationship. The second mating portion 16 is close to a center of the receptacle connector 100 in the width direction, while the first mating portion 15 is outside of second mating portion 16. Each mating portion 12 defines one contact-receiving slot 13 extending through the receiving portion 11 for accommodating one female contact. Each mating portion 12 defines a pair of sideward slots 121 extending forwardly therethrough. The sideward slots 121 are adapted for mating with the plug connector 200 for stabilization. The sideward slots 121 extend rearwardly into the receiving portion 11 and in communication with corresponding contact-receiving slot 13. As a result, heat generated by the female contacts can be dissipated to the exterior via such sideward slots 121.

The first mating portion 15 is substantially of a rectangular shape. The first mating portion 15 and the second mating portion 16 are of the same configuration except that the second mating portion 16 includes a trapezoid anti-mismating block 122 at a corner thereof. The anti-mismating block 122 protrudes along the second direction (i.e., a width direction of the receptacle insulative housing 10) opposite to the first mating portion 15. As a result, the anti-mismating block 122 can prevent the receptacle connector 100 from mating with unmatched plug connectors. As shown in FIG. 3, the trapezoid anti-mismating block 122 comprises a first anti-mismating block and a second anti-mismating block, the first anti-mismating block and the second anti-mismating block protruding from the second mating portions 16 toward the center of receptacle connector 100 along opposite directions. One of the first anti-mismating block and the second anti-mismating block is at an upper position and the other is at a lower position, and the first anti-mismating block and the second anti-mismating block at least partly overlap with each other along a vertical direction.

The receiving portion 11 includes a top wall 111, a bottom wall 112 opposite to the top wall 111 and a pair of side walls 113 connecting the top wall 111 and the bottom wall 112. Besides, the receptacle insulative housing 10 includes a pair of locking arms 14 located at opposite sides of the first mating portion 15 for locking with the plug connector 200. According to the illustrated embodiment of the present invention, the pair of locking arms 14 are integrally connected to the top wall 111 and the bottom wall 112, respectively. Each locking arm 14 includes a pivot portion 142 connected to the top wall 111 or the bottom wall 112, a rear pressing portion 141 for deforming the locking arm 14 and a front distal hook 143 located at opposite sides of the first mating portion 15. The pair of locking arms 14 are corresponding to the first mating portion 15 while offset from the second mating portion 16. In another word, the pair of locking arms 14 are located at opposite sides of the first mating portion 15 rather than the second mating portion 16.

Figure 4:
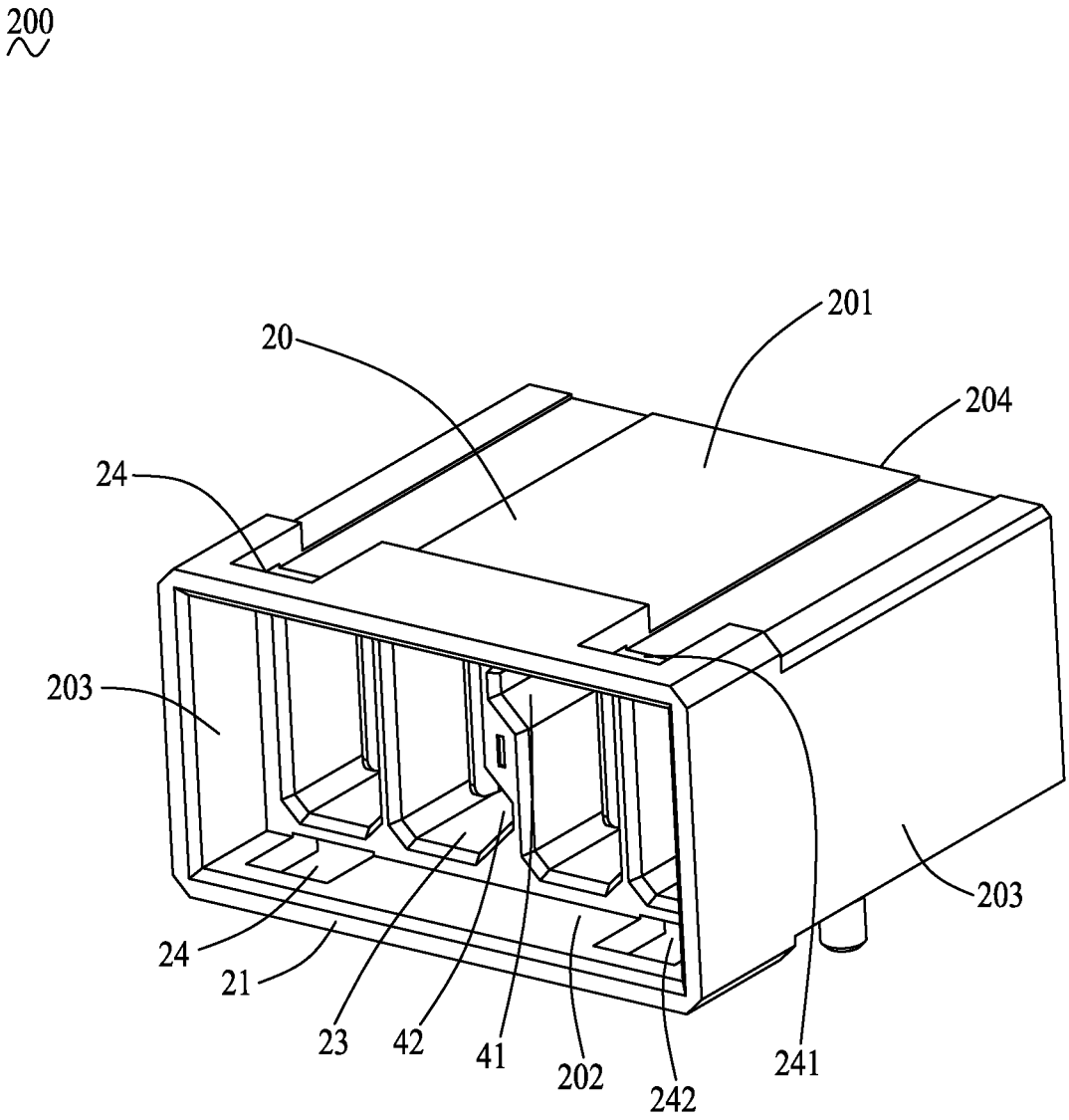
FIG. 4 is a perspective view of a plug connector as shown in FIG. 1.
Figure 5:
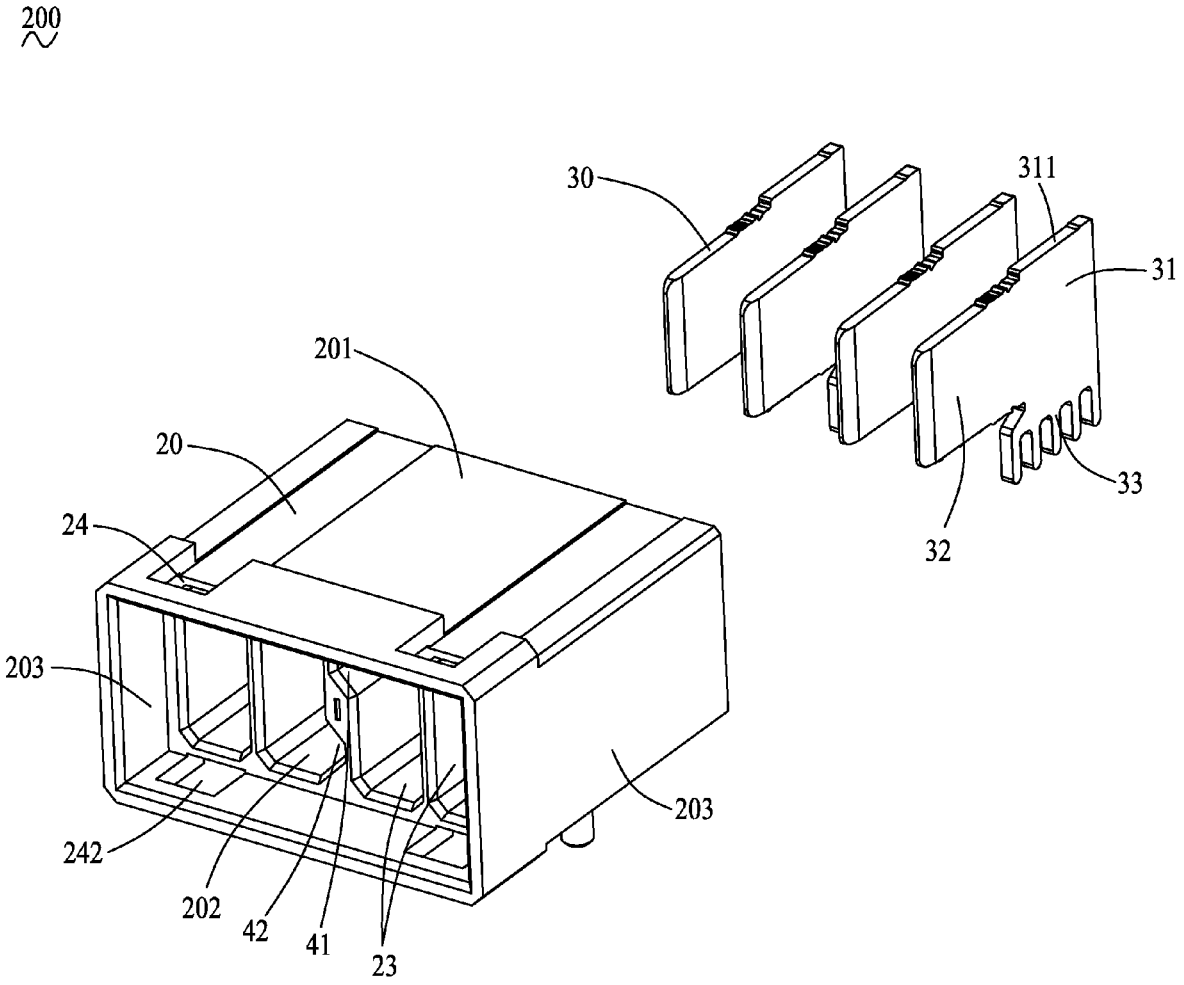
FIG. 5 is another perspective view of the plug connector as shown in FIG. 4.

Referring to FIGS. 1, 4 and 5, the plug connector 200 includes a plug insulative housing 20 and a plurality of male contacts 30 retained in the plug insulative housing 20.

Referring to FIGS. 4 to 7, the plug insulative housing 20 includes a mating surface 21, a mounting surface 22, a plurality of cavities 23 extending forwardly through the mating surface 21 and a plurality of contact-receiving slots 25 extending rearwardly through the mounting surface 22.

Figure 6:
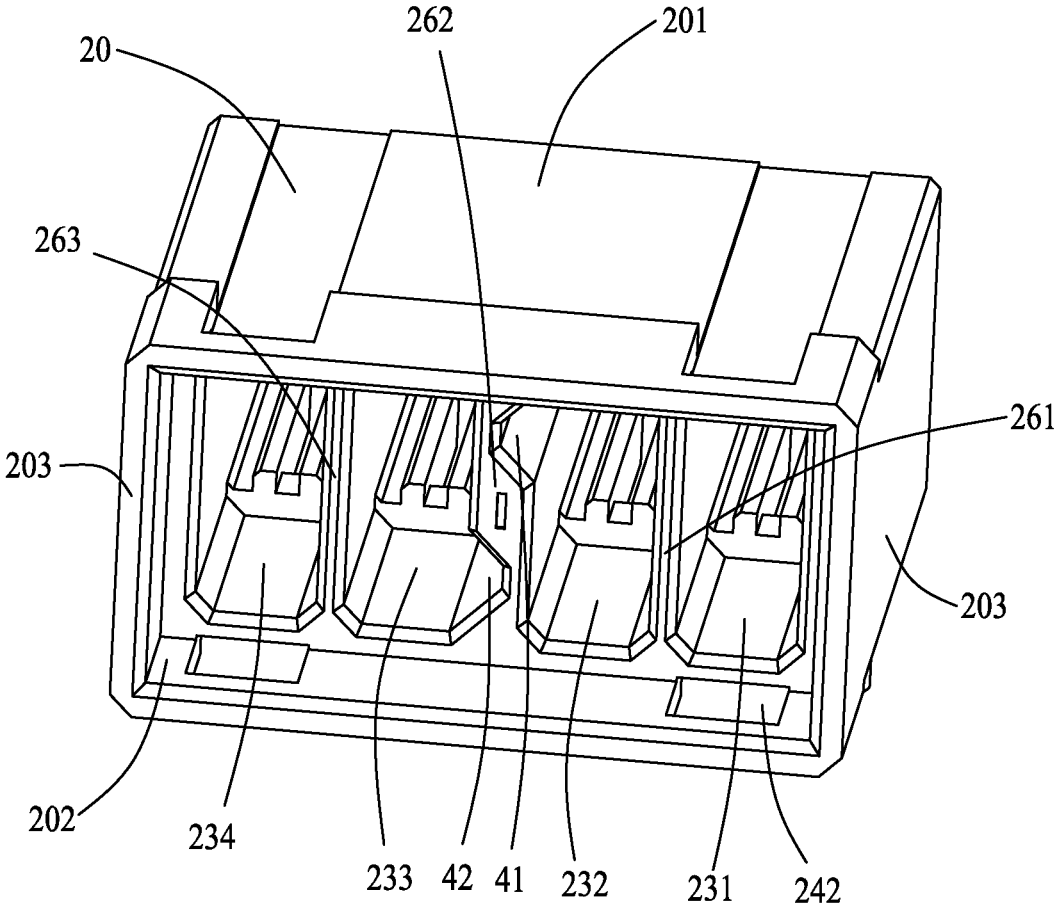
FIG. 6 is a perspective view of a plug insulative housing as shown in FIG. 5.

The plug insulative housing 20 includes a top wall 201, a bottom wall 202, a pair of side walls 203 connecting the top wall 201 and the bottom wall 202, and a rear wall 204 having the mounting surface 22. The cavities 23 are cooperatively enclosed by the top wall 201, the bottom wall 202, the sidewalls 203 and the rear wall 204. As shown in FIG. 6, according to the illustrated embodiment of the present invention, the cavities 23 include a first cavity 231, a second cavity 232, a third cavity 233 and a fourth cavity 234 arranged in turn side by side along the second direction. The plug insulative housing 20 includes a first partition wall 261 separating the first cavity 231 and the second cavity 232, a second partition wall 262 separating the second cavity 232 and the third cavity 233, and a third partition wall 263 separating the third cavity 233 and the fourth cavity 234. The plug insulative housing 20 includes a plurality of locking members 24 for mating with the locking arms 14 of the receptacle connector 100 for stabilization. According to the illustrated embodiment of the present invention, the locking members 24 include a top opening 241 extending upwardly through the top wall 201 and a bottom opening 242 extending downwardly through the bottom wall 202 to lock with the locking arms 14. The top opening 241 and the bottom opening 242 are located adjacent to the mating surface 21.

Besides, the plug insulative housing 20 defines a first anti-mismating groove 41 at a corner of the second cavity 232 and a second anti-mismating groove 42 at a corner of the third cavity 233. The first anti-mismating groove 41 and the second anti-mismating groove 42 are in communication with the second cavity 232 and the third cavity 233, respectively. The first anti-mismating groove 41 and the second anti-mismating groove 42 are recessed into the second partition wall 262 along opposite directions. According to the illustrated embodiment of the present invention, the first anti-mismating groove 41 and the second anti-mismating groove 42 are of trapezoid configurations. The second partition wall 262 is thicker along the second direction than either the first partition wall 261 or the third partition wall 263 for providing reasonable space to form the first anti-mismating groove 41 and the second anti-mismating groove 42. The first anti-mismating groove 41 and the second anti-mismating groove 42 at least partly overlap with each other along a vertical direction.

Figure 7:
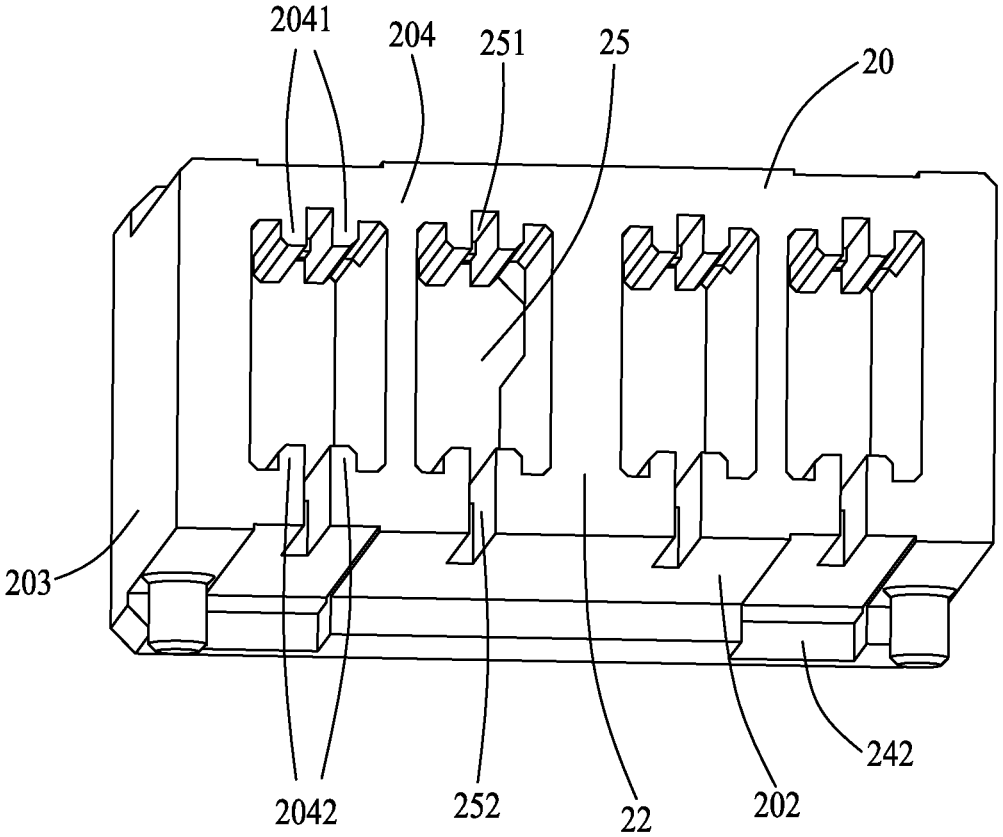
FIG. 7 is another perspective view of the plug insulative housing as shown in FIG. 6.

As shown in FIG. 7, the rear wall 204 includes a pair of upper protrusions 2041 adjacent to the top wall 201 and a pair of lower protrusions 2042 adjacent to the bottom wall 202. Each contact-receiving slot 25 includes a top retaining slot 251 formed between the pair of upper protrusions 2041 and a bottom retaining slot 252 formed between the pair of lower protrusions 2042. The top retaining slot 251 and the bottom retaining slot 252 are in alignment with each other for jointly fixing the male contact 30. Besides, the bottom retaining slot 252 extends downwardly through the bottom wall 202.

Figure 8:
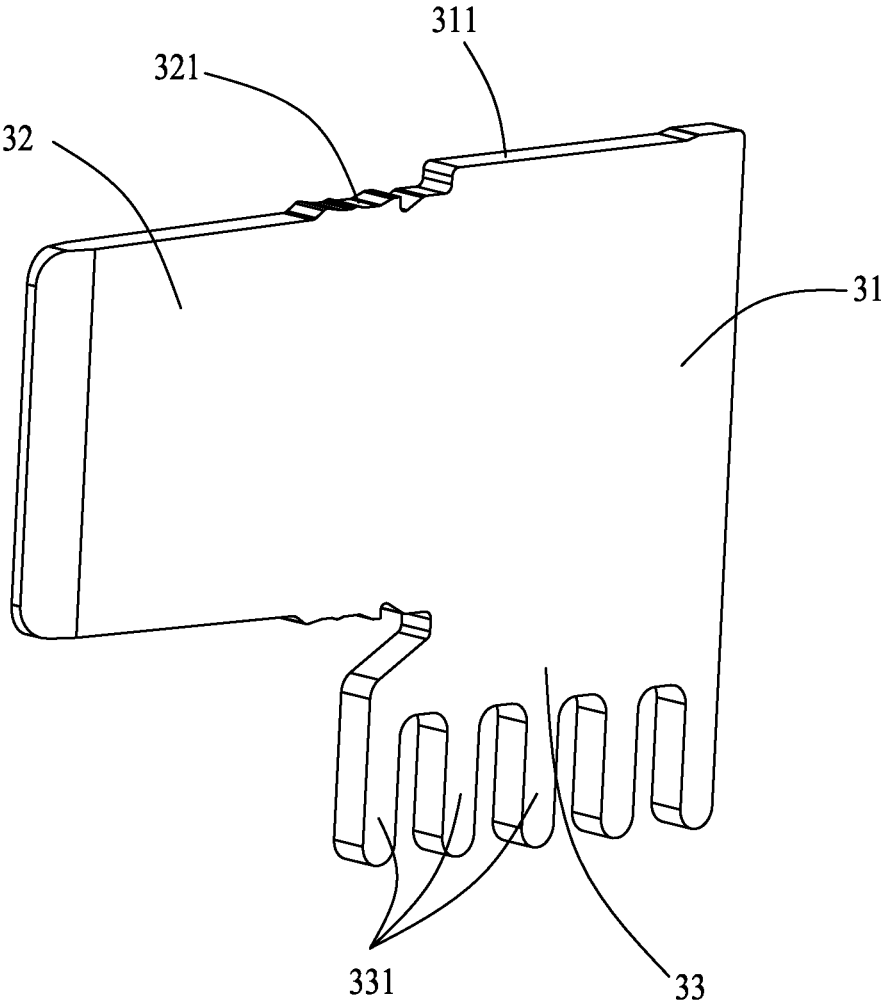
FIG. 8 is a perspective view of a male contact as shown in FIG. 5.

Referring to FIGS. 6 to 8, the male contacts 30 are fixed in the contact-receiving slots 25 and extend into the cavities 23. Each male contact 30 is flat L-shaped and includes a retaining portion 31 fixed in the contact-receiving slot 25, a contacting portion 32 extending horizontally from the retaining portion 31 and extending into corresponding cavity 23, and a soldering portion 33 extending vertically from the retaining portion 31 and extending beyond the bottom wall 202 through the bottom retaining slot 252. The retaining portion 31 is higher than the contacting portion 32 and includes a top protrusion 311 fixed in the top retaining slot 251 for restricting movement of the male contact 30. The contacting portion 32 includes a plurality of barbs 321 fixed in corresponding contact-receiving slot 25 for holding the male contact 30. According to the illustrated embodiment of the present invention, the soldering portion 33 includes a plurality of soldering legs 331 for being mounted to a circuit board.

Referring to FIGS. 1, 3, 4 and 6, when the receptacle connector 100 and the plug connector 200 are mating with each other, the first mating portion 15 and the second mating portion 16 of the receptacle connector 100 are received in the first cavity 231 and the second cavity 232 of the plug connector 200. The anti-mismating block 122 is received in corresponding first anti-mismating groove 41. It is understandable that the receptacle connector 100 which is suitable for the first cavity 231 and the second cavity 232 can also be inserted into the third cavity 233 and the fourth cavity 234 if such receptacle connector 100 is rotated 180 degrees. Besides, with the hooks 143 of the locking arms 14 abutting against the top opening 241 and the bottom opening 242, the mating stability of the plug connector 200 and the receptacle connector 100 can be improved.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A receptacle connector comprising:

a receptacle insulative housing comprising a receiving portion, a plurality of mating portions extending from the receiving portion along a first direction and a plurality of contact-receiving slots extending through the mating portions and the receiving portion; and a plurality of female contacts received in the contact-receiving slots; wherein the plurality of mating portions comprise a first mating portion and a second mating portion in parallel relationship with each other; wherein the second mating portion is close to a center of the receptacle connector in a width direction thereof, while the first mating portion is outside of the second mating portion; and wherein the first mating portion and the second mating portion are of the same configuration except that the second mating portion comprises a trapezoid anti-mismating block which protrudes from a-a corner thereof along the width direction perpendicular to the first direction.

2. The receptacle connector as claimed in claim 1, wherein the trapezoid anti-mismating block comprises a first anti-mismating block and a second anti-mismating block, the first anti-mismating block and the second anti-mismating block protruding from the second mating portions toward the center of the receptacle connector along opposite directions.

3. The receptacle connector as claimed in claim 1, wherein one of the first anti-mismating block and the second anti-mismating block is at an upper position and the other is at a lower position, and wherein the first anti-mismating block and the second anti-mismating block at least partly overlap with each other along a vertical direction.

4. The receptacle connector as claimed in claim 1, wherein the receptacle insulative housing comprises a pair of locking arms integrally formed at opposite sides of the receiving portion, each locking arm comprising a pivot portion integrally connected to the receiving portion, a pressing portion deforming the locking arm and a distal hook for locking with a plug connector.

5. The receptacle connector as claimed in claim 4, wherein the pair of locking arms are corresponding to the first mating portion while offset from the second mating portion.

6. A plug connector comprising:

a plug insulative housing comprising a mating surface, a mounting surface, a plurality of cavities extending forwardly through the mating surface and a plurality of contact-receiving slots extending rearwardly through the mounting surface; and a plurality of male contacts fixed in the contact-receiving slots and extending into the cavities; wherein the cavities comprise a first cavity, a second cavity, a third cavity and a fourth cavity arranged in turn side by side, the plug insulative housing comprises a first partition wall separating the first cavity and the second cavity, a second partition wall separating the second cavity and the third cavity, and a third partition wall separating the third cavity and the fourth cavity, the plug insulative housing defines a first anti-mismating groove at a corner of the second cavity and a second anti-mismating groove at a corner of the third cavity, the first anti-mismating groove and the second anti-mismating groove are in communication with the second cavity and the third cavity, respectively, the first anti-mismating groove and the second anti-mismating groove are recessed into the second partition wall along opposite directions.

7. The plug connector as claimed in claim 6, wherein the first anti-mismating groove and the second anti-mismating groove are of trapezoid configurations.

8. The plug connector as claimed in claim 6, wherein the second partition wall is thicker than either the first partition wall or the third partition wall so as to provide reasonable space to form the first anti-mismating groove and the second anti-mismating groove.

9. The plug connector as claimed in claim 6, wherein the first anti-mismating groove and the second anti-mismating groove at least partly overlap with each other along a vertical direction.

10. The plug connector as claimed in claim 6, wherein the plug insulative housing comprises a top wall, a bottom wall, a pair of side walls and a rear wall having the mounting surface, the rear wall comprising a pair of upper protrusions adjacent to the top wall, each contact-receiving slot comprising a top retaining slot formed between the pair of upper protrusions for holding the male contacts.

11. The plug connector as claimed in claim 10, wherein the rear wall comprises a pair of lower protrusions adjacent to the bottom wall, each contact-receiving slot comprising a bottom retaining slot formed between the pair of lower protrusions for holding the male contacts.

12. The plug connector as claimed in claim 11, wherein the bottom retaining slot extends downwardly through the bottom wall.

13. The plug connector as claimed in claim 6, wherein each male contact is L-shaped and comprises a retaining portion fixed in corresponding contact-receiving slot, a contacting portion extending horizontally from the retaining portion and extending into corresponding cavity, and a soldering portion extending vertically from the retaining portion and extending beyond the plug insulative housing.

14. A connector assembly comprising:

a receptacle connector and a plug connector mating with the receptacle connector;

the receptacle connector comprising:

a receptacle insulative housing comprising a receiving portion, a plurality of mating portions extending from the receiving portion along a first direction and a plurality of contact-receiving slots extending through the mating portions and the receiving portion, at least one of the mating portions located near a center of the receptacle connector formed with an anti-mismating block protruding from a corner thereof along a width direction perpendicular to the first direction; and a plurality of female contacts received in the contact-receiving slots;

the plug connector comprising:

a plug insulative housing comprising a mating surface and a plurality of cavities extending through the mating surface in the first direction to receive the mating portions of the receptacle connector; and a plurality of male contacts fixed in the plug insulative housing and extending into the cavities to mate with the female contacts; wherein the plug insulative housing defines an anti-mismating groove at a corner of one of the cavities which is located near a center of the plug connector in a width direction thereof to receive the anti-mismating block of the receptacle insulative housing.

15. The connector assembly as claimed in claim 14, wherein each male contact is L-shaped and comprises a retaining portion fixed in plug insulative housing, a contacting portion extending horizontally from the retaining portion and extending into corresponding cavity, and a soldering portion extending vertically from the retaining portion and extending beyond the plug insulative housing.

16. The connector assembly as claimed in claim 15, wherein the retaining portion is higher than the contacting portion.

17. The connector assembly as claimed in claim 14, wherein the plug insulative housing comprises a top wall, a bottom wall, a pair of side walls and a rear wall, the cavities being enclosed by the top wall, the bottom wall, the sidewalls and the rear wall.

18. The connector assembly as claimed in claim 17, wherein the plug insulative housing comprises a plurality of contact-receiving slots extending rearwardly through the rear wall to hold the retaining portions of the male contacts, the rear wall comprising a pair of upper protrusions adjacent to the top wall and a pair of lower protrusions adjacent to the bottom wall, each contact-receiving slot comprising a top retaining slot formed between the pair of upper protrusions and a bottom retaining slot formed between the pair of lower protrusions.

19. The connector assembly as claimed in claim 18, wherein the bottom retaining slot extends downwardly through the bottom wall.

20. The connector assembly as claimed in claim 14, wherein the anti-mismating block comprises a first anti-mismating block and a second anti-mismating block, and accordingly, the anti-mismating groove comprises a first anti-mismating groove and the second anti-mismating groove, and wherein the first anti-mismating block and the second anti-mismating block partly overlap with each other along a vertical direction.

* * * * *